United States Patent [19]

DuBois

[11] Patent Number: 4,573,932

[45] Date of Patent: Mar. 4, 1986

[54] ELECTRICAL FLUID PUMPING DEVICE INCLUDING FIRST AND SECOND PUMPING PORTIONS

[75] Inventor: Chester G. DuBois, Zion, Ill.

[73] Assignee: Outboard Marine Corporation, Waukegan, Ill.

[21] Appl. No.: 578,024

[22] Filed: Feb. 8, 1984

[51] Int. Cl.[4] ..... B63H 21/10

[52] U.S. Cl. ..... 440/88; 123/73 AD; 417/503

[58] Field of Search ..... 440/88; 123/73 AD, 196 R; 417/245, 264, 268, 295, 392, 394, 383, 389, 393, 399, 402, 413, 503, 521, 417, 418

[56] References Cited

U.S. PATENT DOCUMENTS

| | | | |
|---|---|---|---|
| 2,926,615 | 3/1960 | Coffey | 417/413 |
| 3,765,802 | 10/1973 | Leitermann | 417/395 |
| 4,263,602 | 4/1981 | Matsumoto et al. | 417/503 |
| 4,381,741 | 5/1983 | Walsworth | 123/73 AD |
| 4,383,504 | 5/1983 | Walsworth | 123/73 AD |

*Primary Examiner*—Galen L. Barefoot
*Assistant Examiner*—Jesûs D. Sotelo
*Attorney, Agent, or Firm*—Michael, Best & Friedrich

[57] ABSTRACT

A marine propulsion device including a fluid pumping device comprising a first mechanism for pumping fluid comprising a pump housing defining a recess, a movable wall which is in the recess and which cooperates with the recess to define a variable volume fluid pumping chamber, a fluid inlet in communication with the fluid pumping chamber, a check valve in the fluid inlet permitting fluid flow into and preventing fluid flow from the fluid pumping chamber, a fluid outlet in communication with the fluid pumping chamber, a check valve in the fluid outlet preventing fluid flow into and permitting fluid flow from the fluid outlet, a spring for moving the movable wall in one direction, a solenoid mechanism comprising a plunger connected to the movable wall and a solenoid coil for moving the plunger and the movable wall in an opposite direction against the action of the spring, and a second mechanism connected to the movable wall for pumping fluid.

12 Claims, 2 Drawing Figures

ELECTRICAL FLUID PUMPING DEVICE INCLUDING FIRST AND SECOND PUMPING PORTIONS

RELATED APPLICATIONS

Attention is directed to the following related U.S. applications: Walsworth application Ser. No. 314,224, filed Oct. 23, 1981, now U.S. Pat. No. 4,473,340; Walsworth application Ser. No. 410,497, filed Aug. 23, 1982, now U.S. Pat. No. 4,539,949; Borst et al application Ser. No. 464,197, filed Feb. 7, 1983; Borst et al application Ser. No. 492,557, filed May 9, 1983, now U.S. Pat. No. 4,471,728; DuBois application Ser. No. 540,045, filed Oct. 7, 1983; and DuBois application Ser. No. 573,302, filed Jan. 23, 1984.

BACKGROUND OF THE INVENTION

This invention relates to electrical fluid pumping devices for pumping two fluids and, more particularly, to such fluid pumping devices driven by solenoid means and incorporated in a marine propulsion device.

Attention is directed to the pumps disclosed in Leitermann et al. U.S. Pat. No. 3,765,802, issued Oct. 16, 1973, and Sweet et al. U.S. Pat. No. 2,951,745, issued Sept. 6, 1960. Attention is also directed to the following U.S. patents: Coffey U.S. Pat. No. 2,926,615, issued Mar. 1, 1960; Jackson U.S. Pat. No. 3,074,346 issued Jan. 22, 1963; Miles et al U.S. Pat. No. 3,273,505 issued Sept. 20, 1966; Savage U.S. Pat. No. 3,286,933 issued Nov. 22, 1966; Hirano U.S. Pat. No. 3,306,217 issued Feb. 28, 1967; Walsworth U.S. Pat. No. 4,381,741 issued May 3, 1983; and Walsworth U.S. Pat. No. 4,383,504 issued May 17, 1983.

SUMMARY OF THE INVENTION

This invention provides a marine propulsion device comprising a propeller, a lower unit rotatably supporting the propeller, and an upper unit supported by the lower unit and including an engine including a crankshaft and carburetion means for supplying fuel to the engine. The marine propulsion device also includes drive train means driven by the crankshaft for rotating the propeller and a fluid pumping device. The fluid pumping device comprises a pump housing defining a recess, a movable wall which is in the recess and which cooperates with the recess to define a variable volume fuel pumping chamber, a fuel inlet in communication with the fuel pumping chamber and adapted to communicate with a source of fuel, check valve means in the fuel inlet permitting fuel flow into and preventing fuel flow from the fuel pumping chamber, and a fuel outlet in communication with the carburetion means and the fuel pumping chamber. The fluid pumping device also includes check valve means in the fuel outlet for permitting fuel flow from and preventing fuel flow into the fuel pumping chamber, biasing means for moving the movable wall in one direction, and solenoid means comprising a plunger connected to the movable wall, and solenoid coil means for moving the plunger and the movable wall in an opposite direction against the action of the biasing means. The fluid pumping device also includes a bore which is in the pump housing and which extends perpendicularly from the movable wall and which partially defines a variable volume oil pumping chamber, and a piston which is received in the bore and which includes a first end attached to the movable wall and a second end cooperating with the bore to form the variable volume oil pumping chamber. The fluid pumping device also includes an oil inlet in communication with the oil pumping chamber and adapted to communicate with a source of oil, check valve means in the oil inlet for permitting oil flow into and preventing oil flow from the oil pumping chamber, an oil outlet in communication with the engine and the oil pumping chamber, and check valve means in the oil outlet for permitting oil flow from and preventing oil flow into the oil pumping chamber.

This invention also provides a fluid pumping device comprising first means for pumping a fluid and comprising a pump housing defining a recess, and a movable wall which is in the recess and which cooperates with the recess to define a variable volume fluid pumping chamber. The first means also includes means for alternately permitting fluid flow into and fluid flow from the fluid pumping chamber, and electrical means for effecting reciprocative movement of the movable wall to effect fluid pumping. The reciprocative moving means comprises a plunger connected to the movable wall, and electrical means for moving the plunger to effect reciprocative movement of the movable wall. The device also includes second means connected to the movable wall for pumping a fluid.

In one embodiment, the plunger moving means includes biasing means for biasing the plunger in one direction, and electrical means in the form of solenoid coil for moving the plunger in an opposite direction against the action of the biasing means.

In one embodiment, the biasing means for biasing the plunger in the one direction comprises a spring in the recess and extending between the movable wall and the pump housing.

In another embodiment, the plunger moving means further includes a second housing with a bore which has an end and which extends perpendicularly from the movable wall, and the plunger is received in the bore. The biasing means for biasing the plunger in the one direction comprises a spring in the bore and extending between the plunger and the end of the bore.

In one embodiment, the means for alternately permitting fluid flow into and fluid flow from the fluid pumping chamber comprises a fluid inlet in communication with the pumping chamber and adapted to communicate with a first source of fluid, check valve means in the fluid inlet permitting fluid flow into and preventing fluid flow from the pumping chamber, a fluid outlet in communication with the fluid pumping chamber, and check valve means in the fluid outlet for permitting fluid flow from and preventing fluid flow into the fluid pumping chamber. The second means for pumping a fluid comprises a bore which is in the pump housing and which extends perpendicularly from the movable wall and which partially defines a second variable volume fluid pumping chamber, and a piston which is received in the bore and which includes a first end and a second end. The first end is attached to the movable wall and the second end cooperates with the bore to form the second pumping chamber. The second means for pumping a fluid also includes a second fluid inlet in communication with the second pumping chamber and adapted to communicate with a second source of fluid, check valve means in the second fluid inlet for permitting fluid flow into and preventing fluid flow from the second pumping chamber, a second fluid outlet in communication with the second pumping chamber, and check valve means in the second fluid outlet for permitting fluid flow from and preventing fluid flow into the second pumping chamber.

Other features and advantages of the embodiments of the invention will become apparent upon review of the following drawings, the detailed description and the appended claims.

Figure 1:
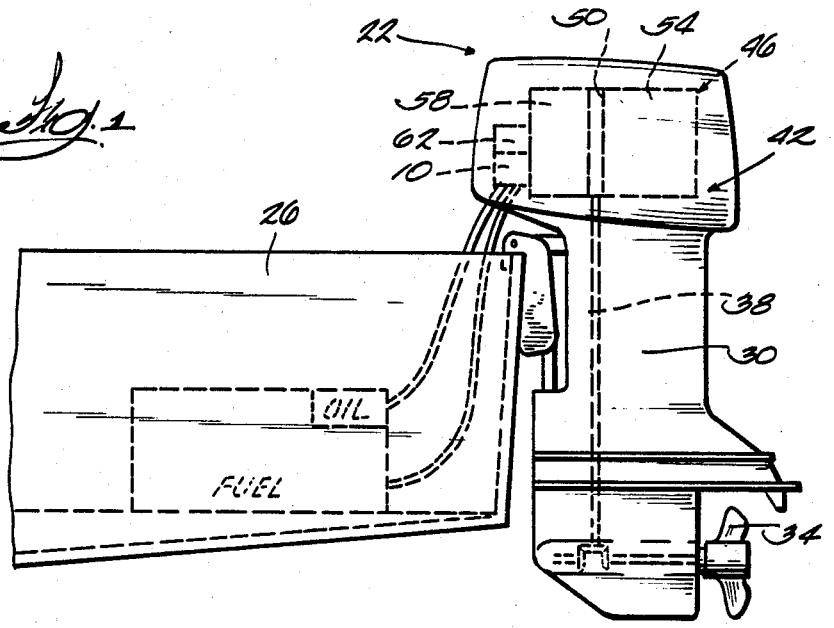
FIG. 1 is a side view of a marine propulsion device mounted on a marine vehicle. The propulsion device includes a fluid pumping device (illustrated schematically) which embodies various of the features of the invention.

Before explaining at least one of the embodiments of the invention in detail, it is to be understood that the invention is not limited in its application to the details of construction and the arrangement of the components set forth in the following description or illustrated in the drawings. The invention is capable of other embodiments and of being practiced or carried out in various ways. Also, it is to be understood that the phraseology and terminology employed herein is for the purposes of description and should not be regarded as limiting.

DESCRIPTION OF THE PREFERRED EMBODIMENTS

Illustrated in the drawings is an electrical fluid pumping device 10 including a first fluid pumping portion 14 for pumping a first fluid such as fuel, and a second fluid pumping portion 18 for pumping a second fluid such as oil. More particularly, as illustrated schematically in FIG. 1, the device 10 is included in a marine propulsion device 22 mounted on a marine vehicle 26, but the device 10 can also be used in other applications where the pumping of two fluids is desired.

The marine propulsion device 22 includes a lower unit 30 rotatably supporting a propeller 34, and a drive train 38 for rotating the propeller 34. The propulsion device 22 also includes an upper unit 42 which is attached to the lower unit 30 and which includes a two-stroke engine 46 which includes a crankshaft 50 that drives the drive train 38. The two-stroke internal combustion engine 46 also comprises an engine block 54, a crankcase 58 which houses the crankshaft 50, and carburetion means for supplying fuel and oil to the crankcase 58. The carburetion means is in the form of carburetor 62 fixed on the crankcase 58.

Figure 2:
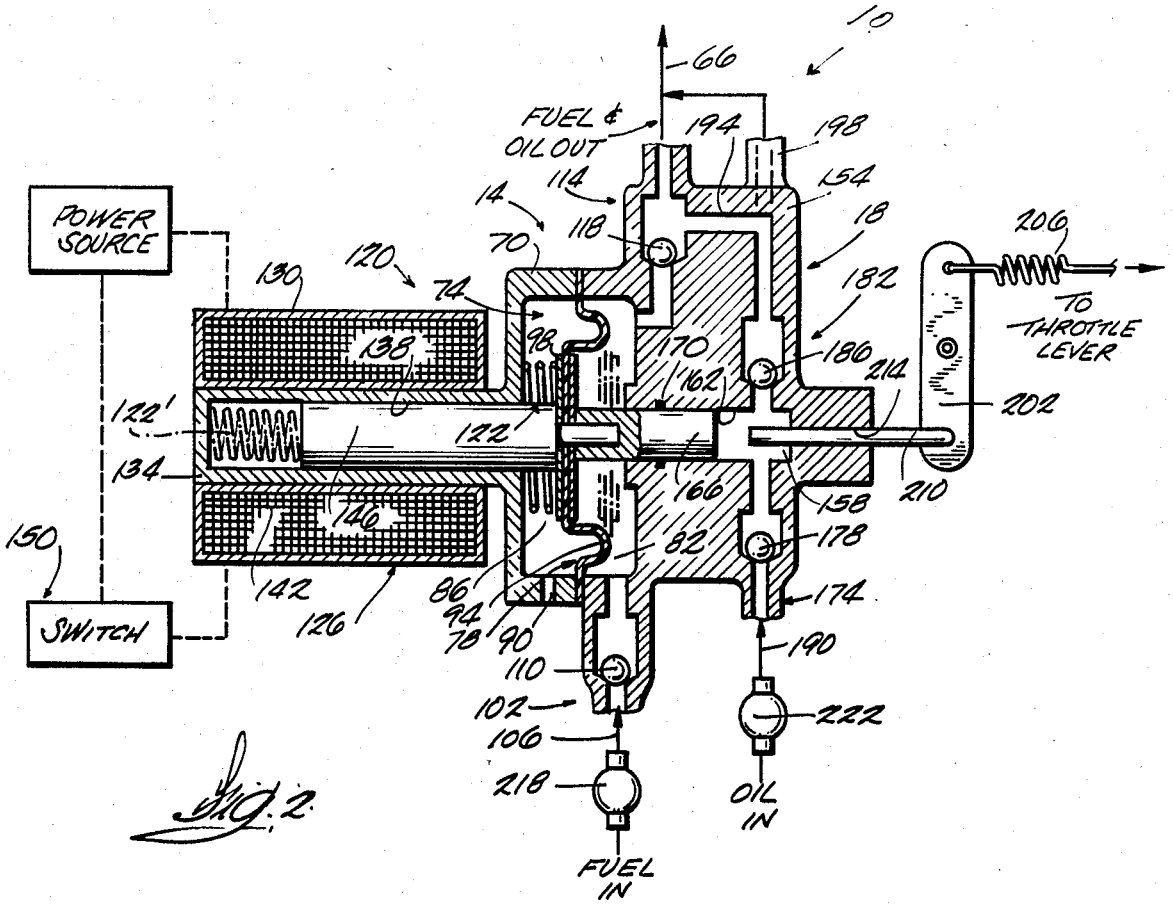
FIG. 2 is a cross-sectional view of a fluid pumping device which embodies various of the features of the invention.

The fluid pumping device 10 is attached to the engine 46 adjacent the carburetor 62 and supplies fuel and oil to the carburetor 62 through a conduit 66 (illustrated schematically in FIG. 2).

As illustrated in FIG. 2, the fuel pumping portion 14 comprises a pump housing 70 which defines a recess 74. The fuel pumping portion 14 also includes a movable wall 78 which is located in the recess 74 and which cooperates with the recess 74 to define a variable volume fuel pumping chamber 82 and an air chamber 86. A vent 90 communicates the air chamber 86 with ambient air.

The movable wall 78 comprises a flexible membrane 94 peripherally connected to the pump housing 70 and a pair of plates secured on opposite sides of the flexible membrane 94 to form a piston portion 98 centrally located in the movable wall 78.

The fuel pumping portion 14 also includes means for alternately permitting fluid flow into and fluid flow from the fuel pumping chamber 82. More particularly, the fuel flow means comprises a fuel inlet 102 in communication with the fuel pumping chamber 82 and communicating through a conduit 106 with a source of fuel located in the marine vehicle 26, a one-way check valve 110 in the fuel inlet 102 which permits fuel flow into and prevents fuel flow from the fuel pumping chamber 82, and a fuel outlet 114 in communication with the fuel pumping chamber 82 and connected by the conduit 66 to the carburetor 62. The fuel flow means also includes a one-way check valve 118 in the fuel outlet 114 for permitting fuel flow from and preventing fuel flow into the fuel pumping chamber 82.

The fluid pumping device 10 further includes electrical means 120 for effecting reciprocative movement of the movable wall 78 to effect fluid pumping from the fuel pumping chamber 82. More particularly, although other constructions can be employed in other embodiments, the reciprocative moving means 120 comprises biasing means 122 for biasing the movable wall 78 in one direction, and solenoid means 126 for moving the movable wall 78 in the opposite direction against the action of the biasing means 122.

Although other constructions can be employed in other embodiments, the biasing means 122 is in the form of a spring which is in the air chamber 86 between the portion of the pump housing 70 forming part of the air chamber 86, and the piston portion 98 of the movable wall 78. The spring 122 is operative to move the movable wall 78 in the one direction thereby decreasing the volume of the fuel pumping chamber 82 and pumping fuel from the fuel pumping chamber 82.

The solenoid means 126 comprises a solenoid housing 130 connected to the fuel pump housing 70 and including a central cylinder 134 which is closed at one end and which forms a central bore 138 that extends from the housing air chamber 86. The solenoid means 126 also includes a solenoid coil 142 wrapped around the central cylinder 134 and enclosed within the solenoid housing 130.

Received in the central bore 138 is a plunger 146 which is connected to the piston portion 98 and which extends perpendicularly therefrom. The solenoid coil 142 is operative on the plunger 146 to move the plunger 146 toward the solenoid housing 130 against the action of the biasing spring 122, as hereinafter described.

Means 150 are also provided for periodically energizing the solenoid coil 142 to move the plunger 146. Such means 150 is considered to be conventional and is therefore not described in detail. Such means 150 can be in the form of an electrical circuit including a power source and switch means for periodically connecting and disconnecting the coil 142 to the power source. An appropriate period between successive coil energizations is chosen so as to provide for the proper rate of fuel flow to the carburetor 62.

In an alternate embodiment (shown by dashed lines in FIG. 2), the biasing spring 122' is located in the solenoid bore 138 between the plunger 146 and the closed end of the cylinder 134 forming the bore 138.

In other embodiments (now shown), the solenoid coil 142 may operate to move the plunger 146 away from the solenoid housing 130, and the spring 122 can be located in the fuel chamber 82 to bias the plunger 146 and the movable wall 78 towards the solenoid housing 130.

In other embodiments (not shown), an electric motor including a plunger connected to the movable wall 78 can be used for the electrical reciprocative moving means 120.

The oil pumping portion 18 for pumping oil includes an oil pump housing 154 integral with the fuel pump housing 70, and a variable volume oil pumping chamber 158 formed by a closed bore 162 extending from the fuel pumping chamber 82, and by the end of a piston 166 received in the bore 162. The other end of the piston 166 is attached to the piston portion 98 of the movable wall 78 and extends perpendicularly therefrom.

In this embodiment, in order to provide for a desired oil to fuel ratio, the volume of the oil pumping chamber 158 is approximately 1/50 the volume of the fuel pumping chamber 82. A seal 170 is also provided around the piston 166 to prevent the flow of fluid around the piston 166.

The oil pumping portion 18 also includes an inlet 174 communicating with the oil chamber 158, a one-way check valve 178 for permitting oil flow into the oil pumping chamber 158 and for preventing oil flow from the oil pumping chamber 158, an outlet 182 communicating with the oil chamber 158, and a one-way check valve 186 for permitting oil flow from the oil pumping chamber 158, and for preventing oil flow into the oil pumping chamber 158.

The oil inlet 174 is connected by conduit 190 to a source of oil located in the marine vehicle 26, and the oil outlet 182 is in communication with the conduit 66 to the carburetor 62 through a passageway 194. The oil passageway 194 is formed in the housing 154 and communicates with the fuel outlet 114. In other embodiments, the oil passageway 194 can be formed by a conduit 198 (shown by dashed lines in FIG. 2) connected to the conduit 66 to the carburetor 62, or connected to some other part of the engine, as desireable.

The fluid pumping device 10 also includes means for varying the volume of the oil pumping chamber 158 in order to vary the oil to fuel ratio as a function of crankshaft revolutions per minute or engine speed. Such varying means comprises a lever 202 which is pivotally mounted at the center thereof adjacent the housing 154, and which is pivotally connected at one end by a spring 206 to a throttle lever (not shown) provided for the carburetor 62. A bar 210 is pivotally attached to the other end of the lever 202 and extends through a bore 214 in the oil pump housing 154 into the variable volume oil pumping chamber 158.

When less oil per unit of fuel is desired at lower engine speed, the bar 210 is inserted by the lever 202 into the oil pumping chamber 158 until the bar 210 contacts the piston 166 before the pumping stroke. When more oil per unit of fuel is desired at higher engine speed, the bar 210 is removed from the oil pumping chamber 158. The spring 206 provides lost motion between the lever 202 and the throttle lever when the bar 210 engages the piston 166.

Priming means in the form of primer pumps 218 and 222 are included in the fuel conduit 106 and the oil conduit 190, respectively, for priming the fluid pumping device 10.

Various of the features of the invention are set forth in the following claims.

I claim:

1. A marine propulsion device comprising a propeller, a lower unit rotatably supporting said propeller, an upper unit supported by said lower unit and including an engine including a crankshaft and carburetion means for supplying fuel to said engine, drive train means driven by said crankshaft for rotating said propeller, and a fluid pumping device comprising a pump housing defining a recess, a movable wall which is in said recess and which cooperates with said recess to define a variable volume fuel pumping chamber, a fuel inlet in communication with said fuel pumping chamber and adapted to communicate with a source of fuel, check valve means in said fuel inlet permitting fuel flow into and preventing fuel flow from said fuel pumping chamber, a fuel outlet in communication with said carburetion means and said fuel pumping chamber, check valve means in said fuel outlet for permitting fuel flow from and preventing fuel flow into said fuel pumping chamber, biasing means for moving said movable wall in one direction, solenoid means comprising a plunger connected to said movable wall, and solenoid coil means for moving said plunger and said movable wall in an opposite direction against the action of said biasing means, a bore which is in said pump housing and which extends perpendicularly from said movable wall and which partially defines a variable volume oil pumping chamber, a piston which is received in said bore and which includes a first end attached to said movable wall and a second end cooperating with said bore to form said variable volume oil pumping chamber, an oil inlet in communication with said oil pumping chamber and adapted to communicate with a source of oil, check valve means in said oil inlet for permitting oil flow into and preventing oil flow from said oil pumping chamber, an oil outlet in communication with said engine and said oil pumping chamber, and check valve means in said oil outlet for permitting oil flow from and preventing oil flow into said oil pumping chamber.

2. A marine propulsion device in accordance with claim 1 wherein said biasing means for moving said movable wall in the one direction comprises a spring in said recess and extending between said movable wall and said pump housing.

3. A marine propulsion device in accordance with claim 1 wherein said solenoid means further includes a solenoid housing with a solenoid bore which has an end and which extends perpendicularly from said movable wall, and wherein said plunger is received in said solenoid bore, and wherein said biasing means for moving said movable wall in the one direction comprises a spring in said solenoid bore and extending between said plunger and said end of said solenoid bore.

4. A marine propulsion device in accordance with claim 1 and further including means for varying the output of said oil pumping chamber in proportion to the revolution rate of said engine crankshaft.

5. Apparatus comprising an engine including carburetion means and a pumping device comprising first means for pumping fuel and comprising a pump housing defining a recess, a movable wall in said recess and cooperating with said recess to define a variable volume fuel pumping chamber, means for effecting fuel flow into said fuel pumping chamber and for effecting fuel flow from said fuel pumping chamber to said carburetion means and including means for effecting reciprocative movement of said movable wall to effect said fuel flow, said reciprocative moving means comprising a plunger connected to said movable wall, and electrical means for moving said plunger to effect reciprocative movement of said movable wall, and second means connected to said movable wall for pumping oil and comprising a second pump housing defining a variable volume oil pumping chamber, means for effecting oil flow into said oil pumping chamber and for effecting oil flow from said oil pumping chamber to said engine, and means connected to said movable wall for common movement therewith and extending into said second pumping chamber to effect pumping of oil in response to movement of said movable wall.

6. Apparatus in accordance with claim 5 wherein said plunger moving means includes biasing means for biasing said plunger in one direction, and wherein said electrical means moves said plunger in an opposite direction against the action of said biasing means.

7. Apparatus in accordance with claim 6 wherein said electrical means for moving said plunger in an opposite direction comprises a solenoid coil.

8. Apparatus in accordance with claim 6 wherein said biasing means for biasing said plunger in the one direction comprises a spring in said recess and extending between said movable wall and said pump housing.

9. Apparatus comprising an engine including carburetion means and a fluid pumping device comprising first means for pumping fuel and comprising a pump housing defining a recess, a movable wall in said recess and cooperating with said recess to define a variable volume fuel pumping chamber, means for effecting fuel flow into said fuel pumping chamber and for effecting fuel flow from said fuel pumping chamber to said carburetion means, and means for effecting reciprocative movement of said movable wall to effect said fuel flow, said reciprocative moving means comprising a plunger connected to said movable wall, and means for moving said plunger to effect reciprocal movement of said movable wall, said plunger moving means including means for biasing said plunger in one direction and comprising a bore having an end, extending perpendicularly from said movable wall, and receiving said plunger, and a spring in said bore and extending between said plunger and said end of said bore, and electrical means for moving said plunger in an opposite direction against the action of said biasing means, and second means connected to said movable wall for pumping oil to said engine.

10. Apparatus comprising an engine including carburetion means and a pumping device comprising a pump housing defining a recess, a movable wall in said recess and cooperating with said recess to define a variable volume fuel pumping chamber, a fuel inlet in communication with said fuel pumping chamber and adapted to communicate with a source of fuel, check valve means in said fuel inlet permitting fuel flow into and preventing fuel flow from said fuel pumping chamber, a fuel outlet in communication with said fuel pumping chamber and with said carburetion means, check valve means in said fuel outlet for permitting fuel flow from and preventing fuel flow into said fuel pumping chamber, biasing means for moving said movable wall in one direction, solenoid means comprising a plunger connected to said movable wall, and solenoid coil means for moving said plunger and said movable wall in an opposite direction against the action of said biasing means, a bore in said pump housing and extending perpendicularly from said movable wall and partially defining a variable volume oil pumping chamber, a piston which is received in said bore and which includes a first end attached to said movable wall and a second end cooperating with said bore to form said oil pumping chamber, an oil inlet in communication with said oil pumping chamber and adapted to communicate with a source of oil, check valve means in said oil inlet for permitting oil flow into and preventing oil flow from said oil pumping chamber, an oil outlet in communication with said oil pumping chamber and said engine, and check valve means in said oil outlet for permitting oil flow from and preventing oil flow into said oil pumping chamber.

11. Apparatus in accordance with claim 10 wherein said biasing means for moving said movable wall in the one direction comprises a spring in said recess and extending between said movable wall and said pump housing.

12. Apparatus in accordance with claim 10 wherein said solenoid means further includes a solenoid housing with a solenoid bore having an end and extending perpendicularly from said movable wall, and wherein said plunger is received in said solenoid bore, and wherein said biasing means for moving said movable wall in the one direction comprises a spring in said solenoid bore and extending between said plunger and said end of said solenoid bore.

* * * * *